US008951067B2

(12) United States Patent
Vroom

(10) Patent No.: US 8,951,067 B2
(45) Date of Patent: Feb. 10, 2015

(54) DOCKING STATION FOR AN ELECTRONIC DEVICE HAVING IMPROVED CONNECTOR INTERFACE

(71) Applicant: Matthew Leigh Vroom, San Francisco, CA (US)

(72) Inventor: Matthew Leigh Vroom, San Francisco, CA (US)

(73) Assignee: Henge Docks LLC, Arlington, VA (US)

( * ) Notice: Subject to any disclaimer, the term of this patent is extended or adjusted under 35 U.S.C. 154(b) by 62 days.

(21) Appl. No.: 13/633,098

(22) Filed: Oct. 1, 2012

(65) Prior Publication Data

US 2014/0094058 A1 Apr. 3, 2014

Related U.S. Application Data

(63) Continuation-in-part of application No. 13/633,089, filed on Oct. 1, 2012, now Pat. No. 8,821,193.

(51) Int. Cl.
*H01R 13/58* (2006.01)

(52) U.S. Cl.
USPC ..... 439/606

(58) Field of Classification Search
USPC ..... 439/606
See application file for complete search history.

(56) References Cited

U.S. PATENT DOCUMENTS

| | | | | | |
|---|---|---|---|---|---|
| 3,535,638 | A | * | 10/1970 | Michelin | 324/149 |
| 4,415,217 | A | * | 11/1983 | Clabburn et al. | 439/488 |
| 4,571,018 | A | * | 2/1986 | Annoot | 439/281 |
| 5,411,405 | A | * | 5/1995 | McDaniels et al. | 439/131 |
| 5,679,026 | A | * | 10/1997 | Fain et al. | 439/651 |
| 5,683,261 | A | * | 11/1997 | Ahles et al. | 439/189 |
| 5,742,464 | A | * | 4/1998 | Ceola et al. | 361/103 |
| 5,762,525 | A | * | 6/1998 | Candeloro | 439/660 |
| 5,792,986 | A | * | 8/1998 | Lee | 174/72 A |
| 5,931,702 | A | * | 8/1999 | Fladung | 439/652 |
| 5,984,717 | A | * | 11/1999 | Lee | 439/501 |
| 6,179,669 | B1 | * | 1/2001 | Chiang | 439/682 |
| 6,319,066 | B2 | * | 11/2001 | Kuo | 439/638 |
| 6,343,957 | B1 | * | 2/2002 | Kuo et al. | 439/638 |
| 6,504,726 | B1 | * | 1/2003 | Grabinger et al. | 361/796 |
| 6,743,052 | B1 | * | 6/2004 | Lin et al. | 439/620.15 |
| 6,843,684 | B2 | * | 1/2005 | Milan | 439/606 |
| 6,991,483 | B1 | * | 1/2006 | Milan et al. | 439/171 |
| 7,035,112 | B2 | * | 4/2006 | Chen | 361/752 |
| 7,393,224 | B2 | * | 7/2008 | Milan | 439/171 |
| 7,419,393 | B2 | * | 9/2008 | Milan | 439/171 |
| 7,503,808 | B1 | * | 3/2009 | O'Shea | 439/639 |
| 7,628,644 | B1 | * | 12/2009 | Peluffo et al. | 439/540.1 |
| 7,658,505 | B2 | * | 2/2010 | Howell | 362/147 |
| 7,988,494 | B2 | * | 8/2011 | Lee | 439/652 |
| 8,059,417 | B2 | * | 11/2011 | Cheng | 361/752 |
| 8,107,243 | B2 | * | 1/2012 | Guccione et al. | 361/728 |
| 8,512,079 | B2 | * | 8/2013 | Vroom et al. | 439/639 |
| 8,512,080 | B2 | * | 8/2013 | Vroom et al. | 439/639 |

(Continued)

*Primary Examiner* — Ross Gushi
(74) *Attorney, Agent, or Firm* — Benjamin E. Maskell

(57) ABSTRACT

Disclosed is a connector module for attaching a plurality of external connectors to an electronic device, comprising a first plug insert injection molded with the connector module, a second plug insert injection molded with the connector module, a first port insert injection molded with the connector module, a second port insert injection molded with the connector module, a first electrical connection between the first plug and the first port, the first electrical connection being insert injection molded with the connector module, a second electrical connection between the second plug and the second port, the second electrical connection being insert injection molded with the connector module, and a first indexing member.

12 Claims, 11 Drawing Sheets

(56) References Cited

U.S. PATENT DOCUMENTS

| | | | | |
|---|---|---|---|---|
| 8,565,884 | B2 * | 10/2013 | Sherva et al. | 607/37 |
| 8,568,160 | B2 * | 10/2013 | Coggins et al. | 439/502 |
| 8,574,010 | B2 * | 11/2013 | Wu | 439/654 |
| D699,183 | S * | 2/2014 | Zaslavsky et al. | D13/110 |
| 2003/0040224 | A1 * | 2/2003 | Fujii et al. | 439/638 |
| 2003/0151938 | A1 * | 8/2003 | Liao | 363/146 |
| 2003/0176109 | A1 * | 9/2003 | Fukuchi et al. | 439/638 |
| 2007/0174532 | A1 * | 7/2007 | Chen | 710/313 |
| 2010/0022106 | A1 * | 1/2010 | Lee | 439/92 |
| 2010/0067197 | A1 * | 3/2010 | Guccione et al. | 361/728 |
| 2010/0167580 | A1 * | 7/2010 | Lee | 439/490 |
| 2012/0094528 | A1 * | 4/2012 | Vroom et al. | 439/540.1 |
| 2013/0137297 | A1 * | 5/2013 | Vroom | 439/540.1 |
| 2013/0252472 | A1 * | 9/2013 | Watanabe et al. | 439/638 |
| 2013/0323981 | A1 * | 12/2013 | Tseng et al. | 439/653 |
| 2014/0004748 | A1 * | 1/2014 | Yu et al. | 439/639 |

* cited by examiner

DOCKING STATION FOR AN ELECTRONIC DEVICE HAVING IMPROVED CONNECTOR INTERFACE

This application is a continuation of U.S. application Ser. No. 13/633,089 filed on Oct. 1, 2012 which is a continuation-in-part of U.S. application Ser. No. 13/306,960 filed Nov. 29, 2011 which is a continuation of U.S. application Ser. No. 13/306,956 filed Nov. 29, 2011 which is a continuation-in-part of U.S. application Ser. No. 12/562,121 filed Sep. 17, 2009, now U.S. Pat. No. 8,105,108. All of the aforementioned applications are hereby incorporated by reference.

BACKGROUND OF THE INVENTION

1. Field of the Invention

The embodiments of the invention relate to a docking station for an electronic device, and more particularly, to a docking station for laptop computers. Although embodiments of the invention are suitable for a wide scope of applications, it is particularly suitable for positioning a plurality of electronic connectors to interface with a laptop computer.

2. Discussion of the Related Art

A docking station for electronic devices refers to a peripheral which facilitates the connection of external connectors to a portable device. Such docking stations usually contain electronic connectors integrated into the body of the docking station that mate with the ports on the docked device. Output ports on the main body of the docking station essentially replicate the ports on the electronic device. The user can then attach connectors for external devices to the output ports of the docking station. Such docking stations are useful because they facilitate the easy insertion and removal of an electronic device without the need to individually connect and disconnect cables for external devices.

Other docking station designs include a plurality of positioning voids in the main body of the docking station where a user can insert their own external connectors. See e.g., U.S. Pat. No. 8,105,108 to Vroom et. al. the entirety of which is incorporated by reference. The positioning voids are sized and positioned to match the size of a predetermined electrical connector and interface port on an electronic device. An integral fastening mechanism is provided which holds the connectors fast in their respective positioning voids.

However, there are drawbacks to these technologies. For example, it can be challenging for non-technical users to insert and fasten external connectors into the multi-void docking station. Further, small variations in the size of the voids due to materials shrinkage and manufacturing tolerances can make properly installed external connectors fail to interface properly with the external device. Also, because the voids are precisely sized for particular external connectors, it is not possible to use external connectors which have bodies of varying sizes.

SUMMARY OF THE INVENTION

Accordingly, embodiments of the invention are directed to a docking station for an electronic device having an improved connector interface that substantially obviates one or more of the problems due to limitations and disadvantages of the related art.

An object of embodiments of the invention is to provide a docking station with an integral port block having prepositioned electrical connectors.

Another object of embodiments of the invention is to provide a precision positioning mechanism for the integral port block.

Yet another object of embodiments of the invention is to provide a docking station for an electronic device which is compatible with external connectors of varying sizes of external connectors.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the docking station for an electronic device with improved connector interface includes a connector module for interfacing with the electronic device, a first plug on the connector module, a second plug on the connector module, a first port on the connector module electrically connected to the first plug, a second port on the connector module electrically connected to the second plug, a base member for holding the connector module, a first indexing member on the base member, and a second indexing member on the connector module.

In another aspect, the docking station for an electronic device with improved connector interface includes a connector module for interfacing with the electronic device, a first plug on the connector module, a second plug on the connector module, a first port on the connector module electrically connected to the first plug, a second port on the connector module electrically connected to the second plug, a base member for holding the connector module, a first indexing member on the base member, a second indexing member on the connector module, wherein the first indexing member interfaces with the second indexing member to position the connector module with respect to the base member, a third indexing member on the base member, a fourth indexing member on the connector module, and wherein the third indexing member interfaces with the fourth indexing member to position the connector module with respect to the base member.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
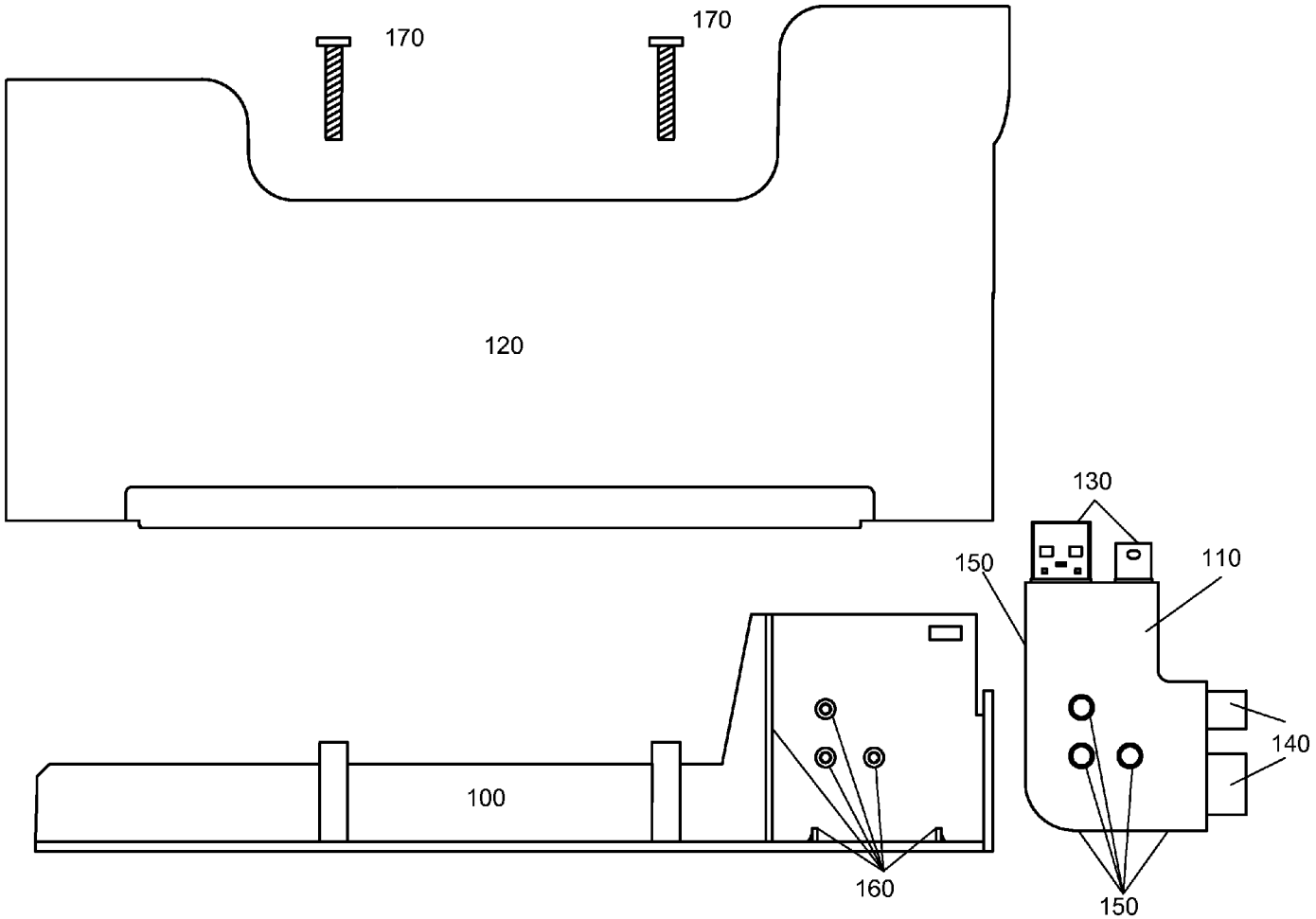
FIG. 1 is an assembly view of a docking station according to exemplary embodiments of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

FIG. 1 is an assembly view of a docking station according to exemplary embodiments of the invention. As shown in FIG. 1, the docking station includes a base member 100, a connector module 110, and a shell 120. The connector module 110 includes a plurality of plugs 130, a plurality of ports 140, and a plurality of indexing members 150. The base member 100 also includes a plurality of indexing members 160. The shell 170 can be fastened to the base member 100 with screws 170.

The plurality of ports 140 on the connector module 110 can replicate the ports on an electronic device (not shown). The each of the plurality of ports 140 can be electrically connected to each of the plurality of plugs 130 so that electrical signals from one of the plugs 130 are passed through to one of the ports 140. The plugs 130 and ports 140 can be USB, MiniDisplay port, Firewire, VGA, DVI, HDMI, SATA, or other connector type.

The plugs 130 on the connector module 110 can be positioned to match the location of the ports (not shown) on a predetermined electronic device (not shown). The connector module 110 can be sized and shaped to be inserted into the base member 100, preferably when the docking station is manufactured. The connector module 110 can be held in place and oriented by a plurality of indexing members 160 on the base member 100 and indexing members 150 on the connector module 110. The indexing members 150 can correspond to the indexing members 160 so each indexing member 150 can interface with exactly one indexing member 160 of the base member 100. The interface of the indexing members 150 and 160 will be described in greater detail in conjunction with FIG. 4.

The shell 120 can cover the base member 100 and the connector module 110. The shell 120 can have an opening (not shown) on the top which is size to receive a predetermined electronic device and orient the electronic device to interface with the plugs 130 of the connector module 110.

Figure 2:
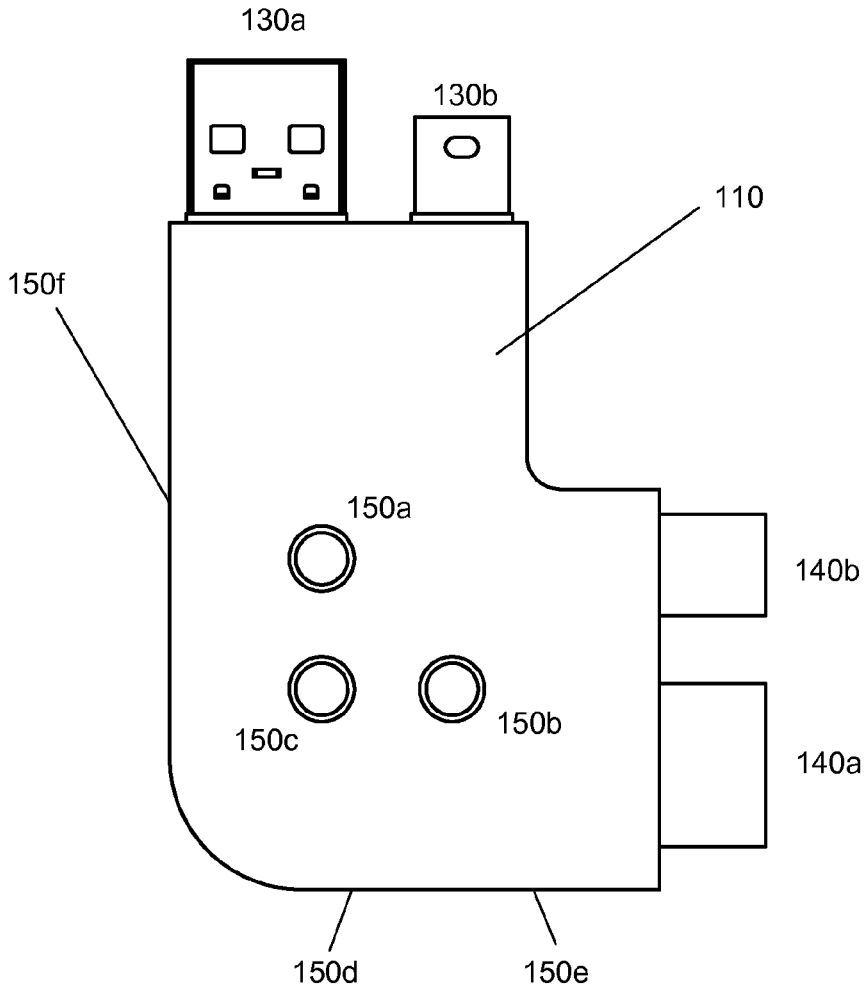
FIG. 2 is a side view of a connector module according to an exemplary embodiment of the invention.

FIG. 2 is a side view of a connector module according to exemplary embodiments of the invention. As shown in FIG. 2, the connector module 110 includes a plurality of plugs 130*a-b*, a plurality of ports 140*a-b*, and a plurality of indexing members 150*a-f*. Plug 130*a* can be electrically connected to port 140*a*. Plug 130*b* can be electrically connected to port 140*b*. The electrical connection between the ports 130*a-b* and 140*a-b* can be via printed circuit board. The electrical connection between the ports 130*a-b* and 140*a-b* can be via cable. The connector module 110 can be formed by insert injection molding (co-molding) whereby the plugs and ports and the electrical connections can be inserted into the mold for the connector module before molten plastic is injected. When molten plastic is injected into the mold, the ports, plugs, and electrical connectors are encased in plastic and held in their respective orientations. For the purposes of this application the terms "insert injection molding" and "co-molding" will have the same meaning as described above.

The plurality of indexing members 150*a-f* are points or features on the body of the connector module 110 which can be used to position or align the connector module 110 within the base member. For example, indexing members 150*a*, 150*b*, and 150*c*, can be recesses or through-holes in the body of the connector module 110. The indexing members 150*a*, 150*b*, and 150*c* can interface with protrusions (not shown) on the base member not shown. An indexing member can also be a side wall of the connector module 150*d*, 150*e*, and 150*f*. The indexing members 150*d*, 150*e*, and 150*f* can interface with corresponding peg, post, or protrusion-style indexing members (not shown) on the base member (not shown). While the indexing members 150*a*, 150*b*, and 150*c* are illustrated in FIG. 2 as recesses or through-holes, indexing members can also be recesses or protrusions in the surface or sidewalls of the connector module 110. The indexing members need not be formed in the body of the connector module 110. For example, the plugs 130*a* and 130*b* can be indexing members. Similarly, the ports 140*a* and 140*b* can be indexing members. Indexing members on the connector module 110 can interface with, correspond to, mate with, or match with complimentary indexing members on the base member. The indexing members can position the connector module 110 within the base member (not shown) and hold the connector module 110 in orientation for the plugs 130*a* and 130*b* to interface with an electronic device (not shown).

Figure 3:
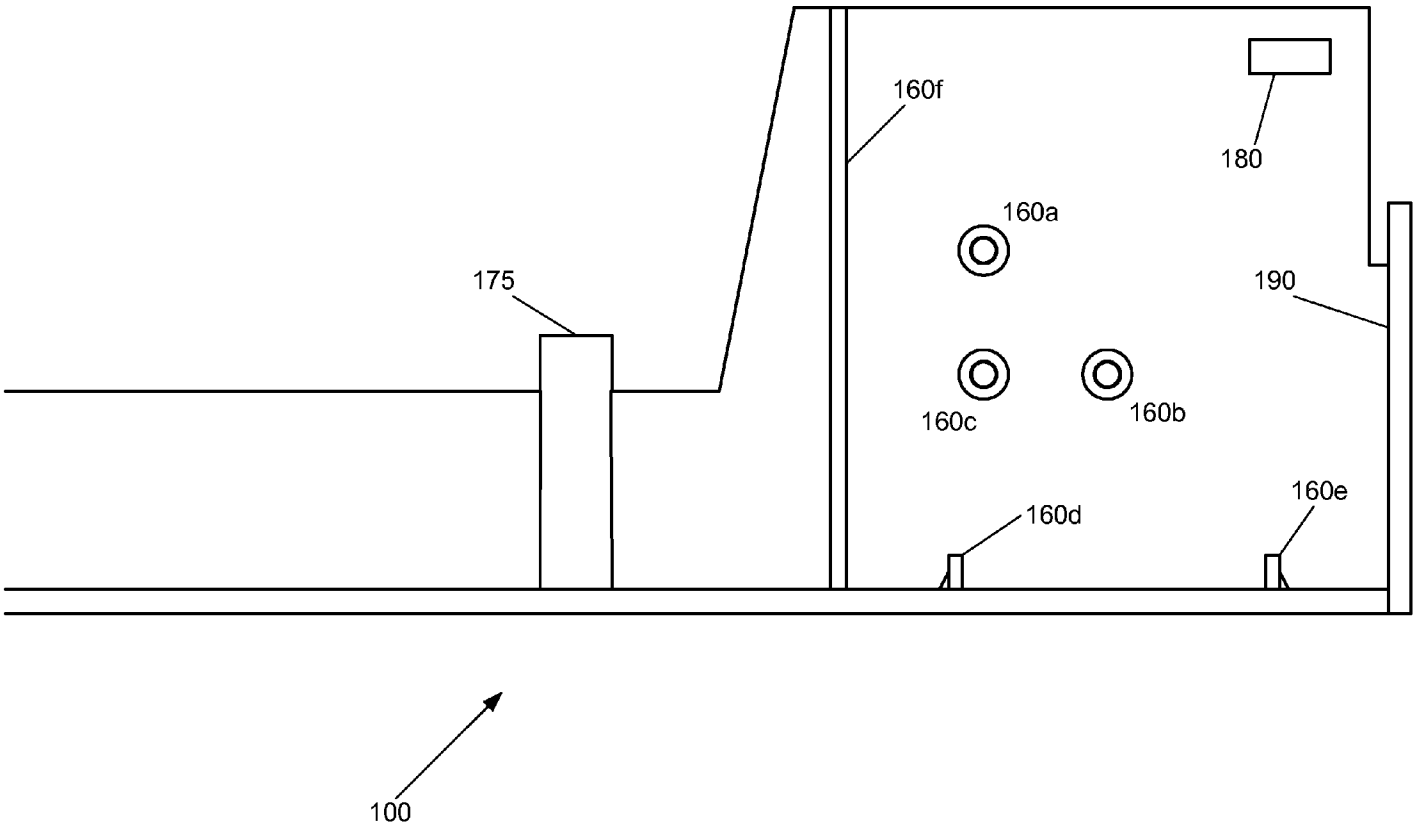
FIG. 3 is a side view of a base member according to exemplary embodiments of the invention.

FIG. 3 is a side view of a base member according to exemplary embodiments of the invention. As shown in FIG. 3, the base member 100 includes a plurality of indexing members 160*a-f*, a screw stud 175, a shell attachment point 180, and a back wall 190. The screw stud 175 can be cylindrical with a bore hole (not shown) down the middle for receiving a screw (not shown). The shell attachment point 180 can be a notch, a depression, or a cutout. The back wall 190 can have cutouts (not shown) to allow passage of the ports (not shown) of the connector module (not shown) so that a user can plug external connectors into the ports (not shown).

Exemplary embodiments of the invention may include a shell (not shown) which covers the base member. The shell can be screwed to the base member 100 at the screw stud 175. The shell can be further attached to the base member 100 at the shell attachment point 180. The shell may include a plastic tab or clip (not shown) which interfaces with the shell attachment point 180 to secure the shell to the base member.

The indexing members 160*a-f* of the base member 100 can be used to position an connector module (not shown) within the base member 100. For example, indexing members 160*a*, 160*b*, and 160*c* can be studs, pegs, posts, or protrusions. The indexing members 160*a*, 160*b*, and 160*c* can correspond to complimentary indexing members on the connector module (not shown). The complimentary indexing members on the connector module can be through holes, recesses, or cutouts. The indexing members 160*a*, 160*b*, and 160*c* can interface with the complimentary indexing members of the connector module to secure, position, and orient the connector module within the base member 100. The base member 100 can also include indexing members 160*d* and 160*e* which can be pegs or studs protruding from the bottom of the base member 100. The indexing members 160*d* and 160*e* can interface with a sidewall of the connector module (not shown) to secure, position, and orient the connector module within the base member 100. The base member 100 can further include an indexing member 160*f* which can be a wall, reinforcing rib, or other raised feature on the base member. The indexing member 160*f* can interface with a sidewall of the connector module (not shown) to secure, position, and orient the connector module within the base member 100.

Figure 4:
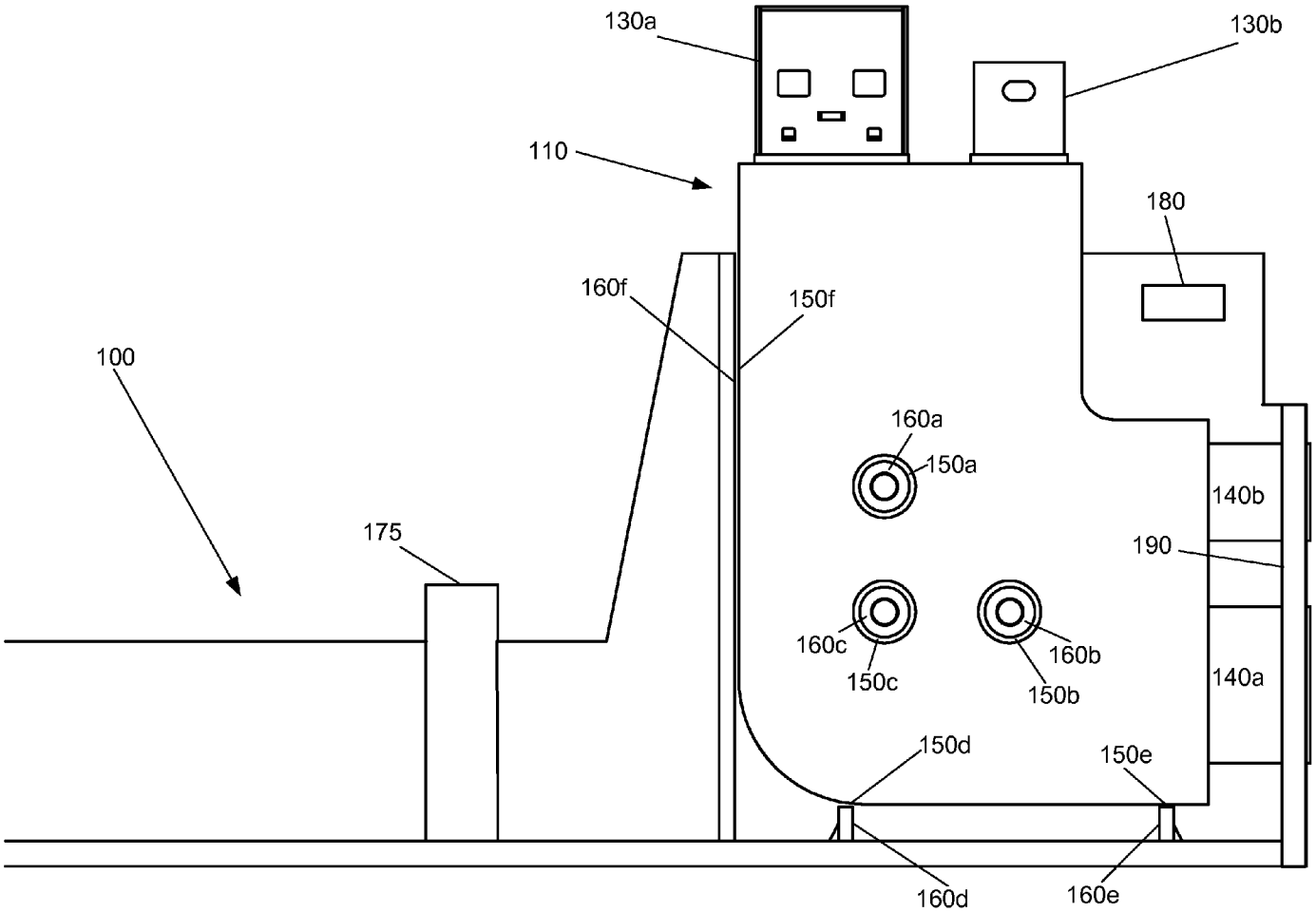
FIG. 4 is a side view of a base member joined with a connector module according to exemplary embodiments of the invention.

FIG. 4 is a side view of a base member joined with a connector module according to exemplary embodiments of the invention. As shown in FIG. 4, the connector module 110 can be joined with the base member 100. The plurality of ports 140*a-b* of the connector module 110 can project through an opening in the rear wall 190 of the base member 100. The plurality of plugs 130*a-b* can be oriented vertically enabling gravity to assist a user in connecting an electronic device.

The connector module 110 can be oriented and secured within the base member 100 by a plurality of indexing members 150*a-f* and 160*a-f*. Indexing members 150*a-c* can be formed as recesses in the connector module 110. Indexing members 160*a-c* can be pegs or posts formed on the base member 100. Indexing members 160*a-c* of the base member 100 can interface with the indexing members 150*a-c* of the connector module. In the exemplary embodiment illustrated in FIG. 4, post-style indexing members 160*a-c* enter into hole-style indexing members 150*a-c*. A sidewall indexing member 150*d-e* of the connector module 110 can interface with post-style indexing members 160*d-e*. Indexing members 160*d-e* can also reinforce the connector module 110 from vertical loads when an electronic device is connected to plugs 130*a-b*. Sidewall indexing member 150*f* of the connector module 110 can interface with the wall indexing member 160*f* of the base member 100. The wall indexing member 160*f* can also reinforce the connector module 110 from horizontal loads when external connectors are inserted into the ports 140*a-b*. For clarity of illustration, the connector module 110 and base member 100 of FIG. 4 include a space or gap between indexing members 160*f* and 150*f*. However, in preferred embodiments of the invention the indexing members 160*f* and 150*f* can be touching.

Exemplary embodiments of the invention may include a shell (not shown) which covers the base member. The shell can be screwed to the base member 100 at the screw stud 175. The shell can be further attached to the base member 100 at the shell attachment point 180. The shell may include a plastic tab or clip (not shown) which interfaces with the shell attachment point 180 to secure the shell to the base member.

Figure 5:
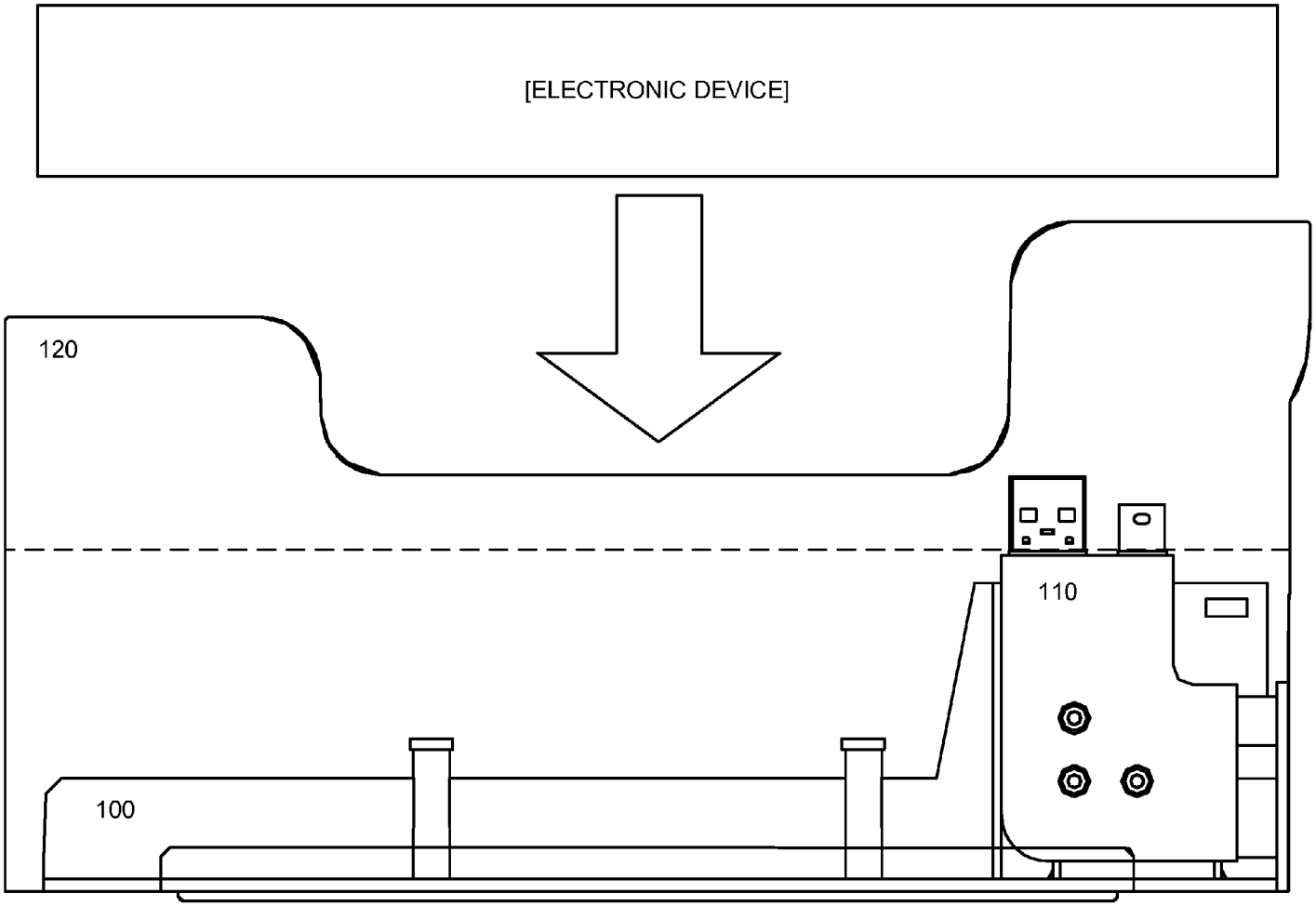
FIG. 5 is side view of a docking station according to exemplary embodiments of the invention.

FIG. 5 is side view of a docking station according to an exemplary embodiment of the invention. As shown in FIG. 5, the docking station includes a base member 100, a connector module 110, and a shell 120. The base member 100 can position and orient the connector module 110. The shell can cover the base member 100 and the connector module 110. The shell can position and orient an electronic device to interface with the connector module 110.

Figure 6:
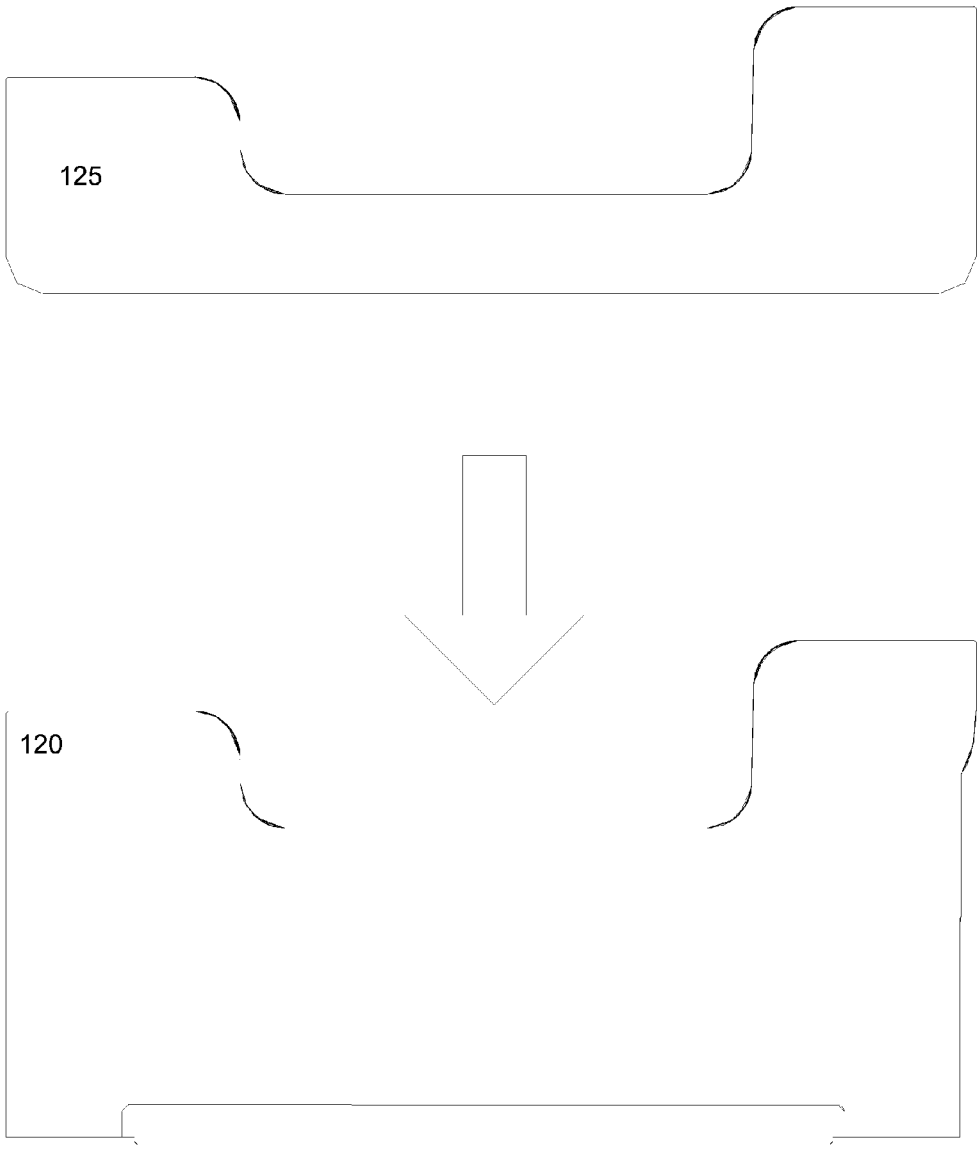
FIG. 6 is a side view of a shell according to an exemplary embodiment of the invention.

FIG. 6 is a side view of a shell according to an exemplary embodiment of the invention. As shown in FIG. 6, the shell 120 can include a liner 125. The liner 125 can match the contour of an electronic device so that the electronic device is securely held in the docking station and the ports of the electronic device are aligned with the plugs of the connector module (not shown). In this way the liner 125 can serve as an indexing member to position and orient an electronic device. The liner 125 can be made of injection molded plastic. The liner 125 can be co-molded or over-molded with rubber or rubberized plastic to prevent damage and scratches to the electronic device when it is introduced into the liner 125 of the shell 120 of the docking station.

Figure 7:
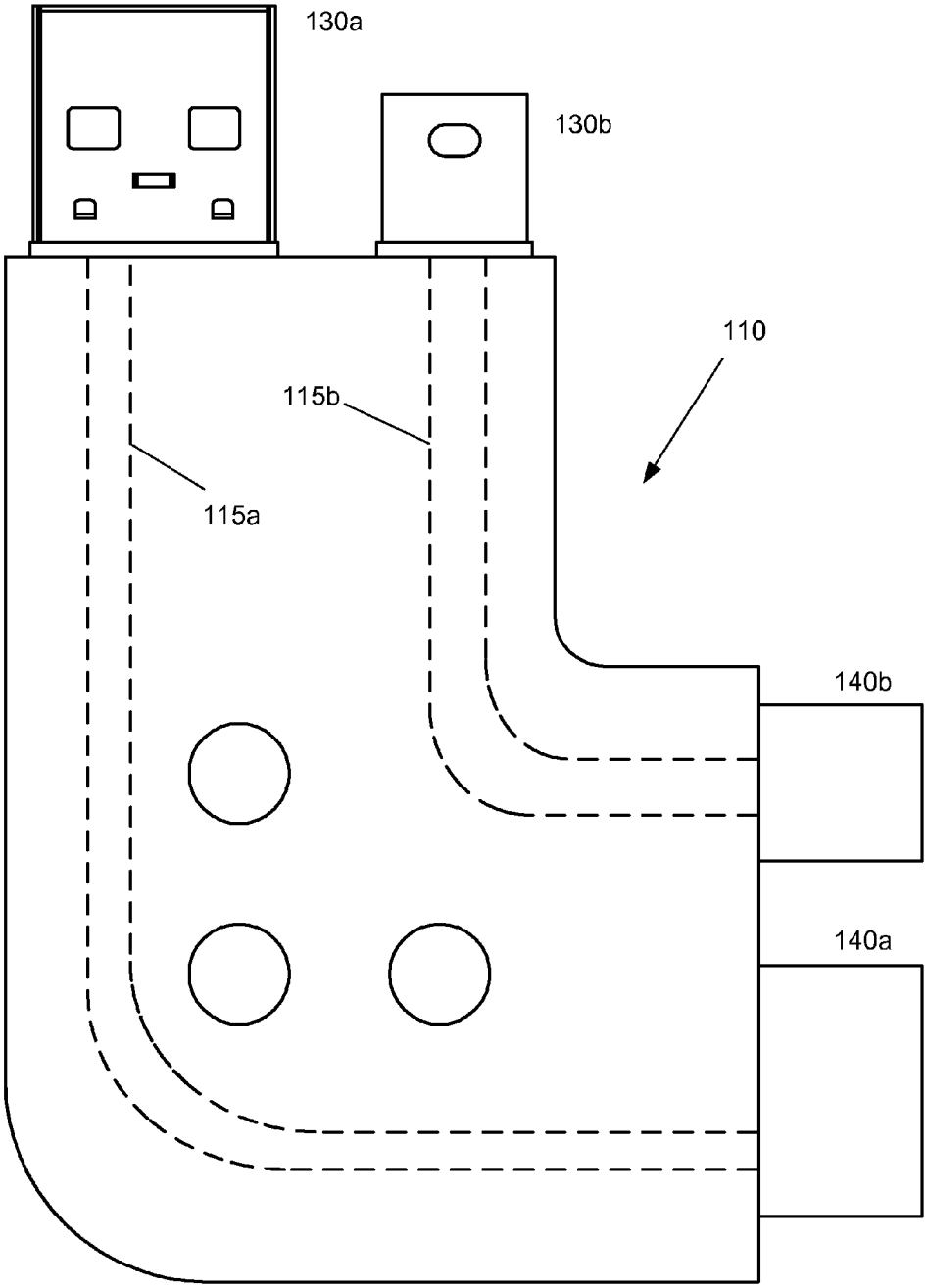
FIG. 7 is a side view of a connector module according to an exemplary embodiment of the invention.

FIG. 7 is a side view of a connector module according to an exemplary embodiment of the invention. As shown in FIG. 7, the connector module 110 includes a plurality of plugs 130*a* and 130*b*, a plurality of ports 140*a* and 140*b*, and electrical connections 115*a* and 115*b* therebetween. The electrical connections can be cables. Plug 130*a* can be electrically connected to port 140*a* with a cable 115*a*. In preferred embodiments of the invention, plug 130*a*, port 140*a*, and 115*a* are assembled into a single unit and inserted into the mold cavity (not shown) for the connector module 110 prior to injection molding. When the connector module is formed via injection molding, the assembly of plug 130*a*, port 140*a*, and cable 115*a* are incased in plastic and held fast when the plastic cools. The plug 130*a* and port 140*a* can extend out of the connector module 110 so that external connectors and or electronic devices can be connected to them. Plug 130*b*, port 140*b*, and cable 115*b* can be formed in similar fashion.

Figure 8:
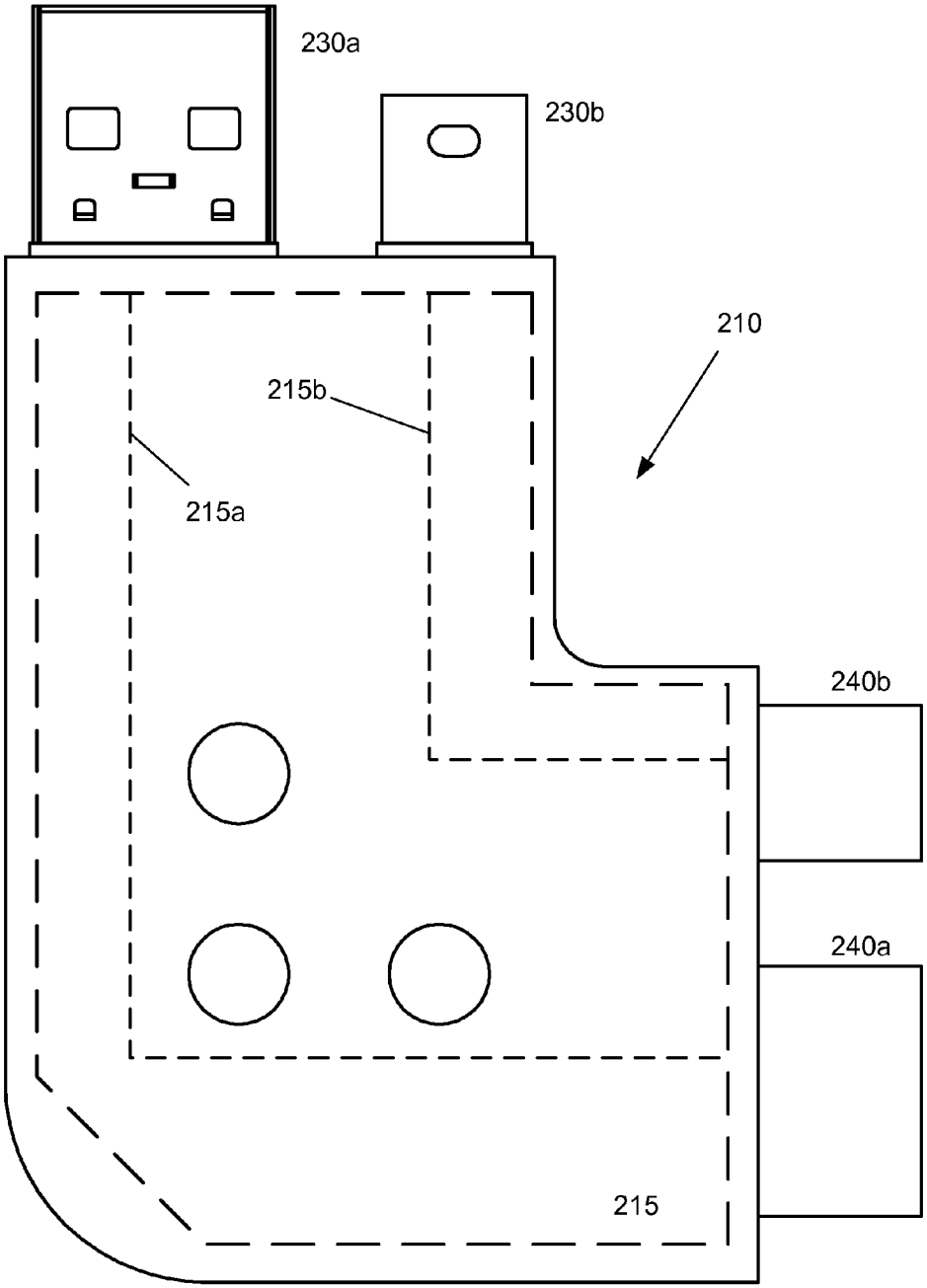
FIG. 8 is a side view of a connector module according to an exemplary embodiment of the invention.

FIG. 8 is a side view of a connector module according to an exemplary embodiment of the invention. As shown in FIG. 8, the connector module 210 includes a plurality of plugs 230*a* and 230*b*, a plurality of ports 240*a* and 240*b*, and a circuit board 215 having electrical connections 215*a* and 215*b*. The electrical connections 215*a* and 215*b* can be electrical traces on the circuit board 215. The plugs 230*a* and 230*b* and the ports 240*a* and 240*b* can be soldered to the circuit board 215.

In preferred embodiments of the invention, plugs 230*a* and 230*b*, ports 240*a* and 240*b*, and circuit board 215 are assembled into a single unit and inserted into the mold cavity (not shown) for the connector module 210 prior to injection molding. When the connector module is formed via injection molding, the assembly of plugs 230*a* and 230*b*, ports 240*a* and 240*b*, and circuit board 215 are incased in plastic and held fast when the plastic cools. The plugs 230*a* and 230*b* ports 240*a* and 240*b* can extend out of the connector module 210 so that external connectors and or electronic devices can be connected to them.

Figure 9:
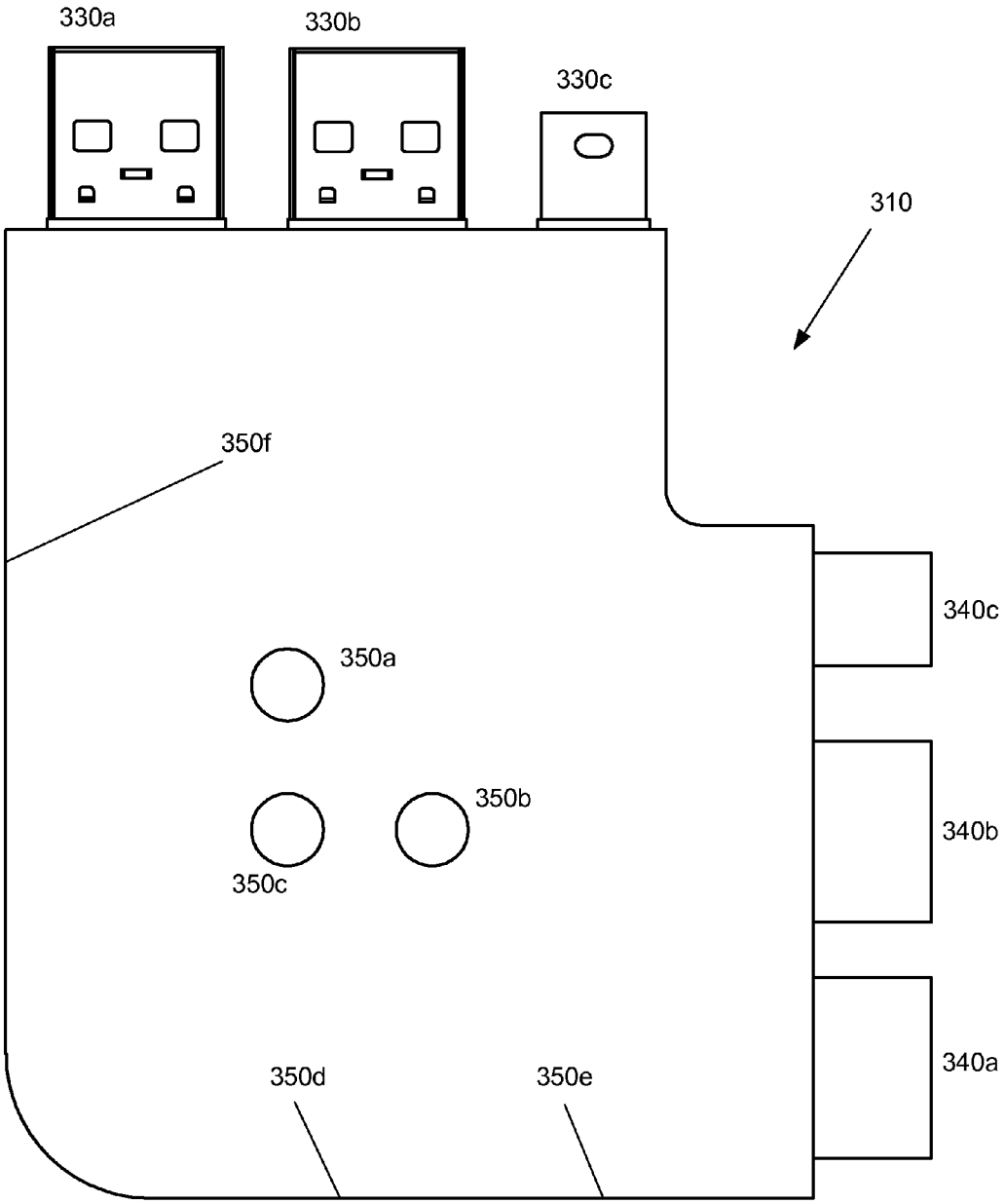
FIG. 9 is a side view of a connector module according to an exemplary embodiment of the invention.

FIG. 9 is a side view of a connector module according to an exemplary embodiment of the invention. As shown in FIG. 9, the connector module 310 includes a plurality of plugs 330*a-b*, a plurality of ports 340*a-b*, and a plurality of indexing members 350*a-f*. Plug 330*a* can be electrically connected to port 340*a*. Plug 330*b* can be electrically connected to port 340*b*. Plug 330*c* can be electrically connected to port 340*c*.

The plurality of indexing members 350*a-f* are points or features on the body of the connector module 310 which can be used to position or align the connector module 310 within the base member. For example, indexing members 350*a*, 350*b*, and 350*c*, can be recesses or through-holes in the body of the connector module 310. The indexing members 350*a*, 350*b*, and 350*c* can interface with protrusions (not shown) on the base member (not shown). An indexing member can also be a side wall of the connector module 350*d*, 350*e*, and 350*f*. The indexing members 350*d*, 350*e*, and 350*f* can interface with corresponding peg, post, or protrusion-style indexing members (not shown) on the base member (not shown). While the indexing members 350*a*, 350*b*, and 350*c* are illustrated in FIG. 9 as recesses or through-holes, indexing members can also be recesses or protrusions in the surface or sidewalls of the connector module 310. The indexing members need not be formed in the body of the connector module 310. For example, the plugs 330*a*, 330*b*, or 330*c* can be indexing members. Similarly, the ports 340*a*, 340*b*, and 340*c* can be indexing members. Indexing members on the connector module 310 can interface with, correspond to, mate with, or match with complimentary indexing members on the base member. The indexing members can position the connector module 310 within the base member (not shown) and hold the connector module 310 in orientation for the plugs 330*a*, 330*b*, and 330*c* to interface with an electronic device (not shown).

Figure 10:
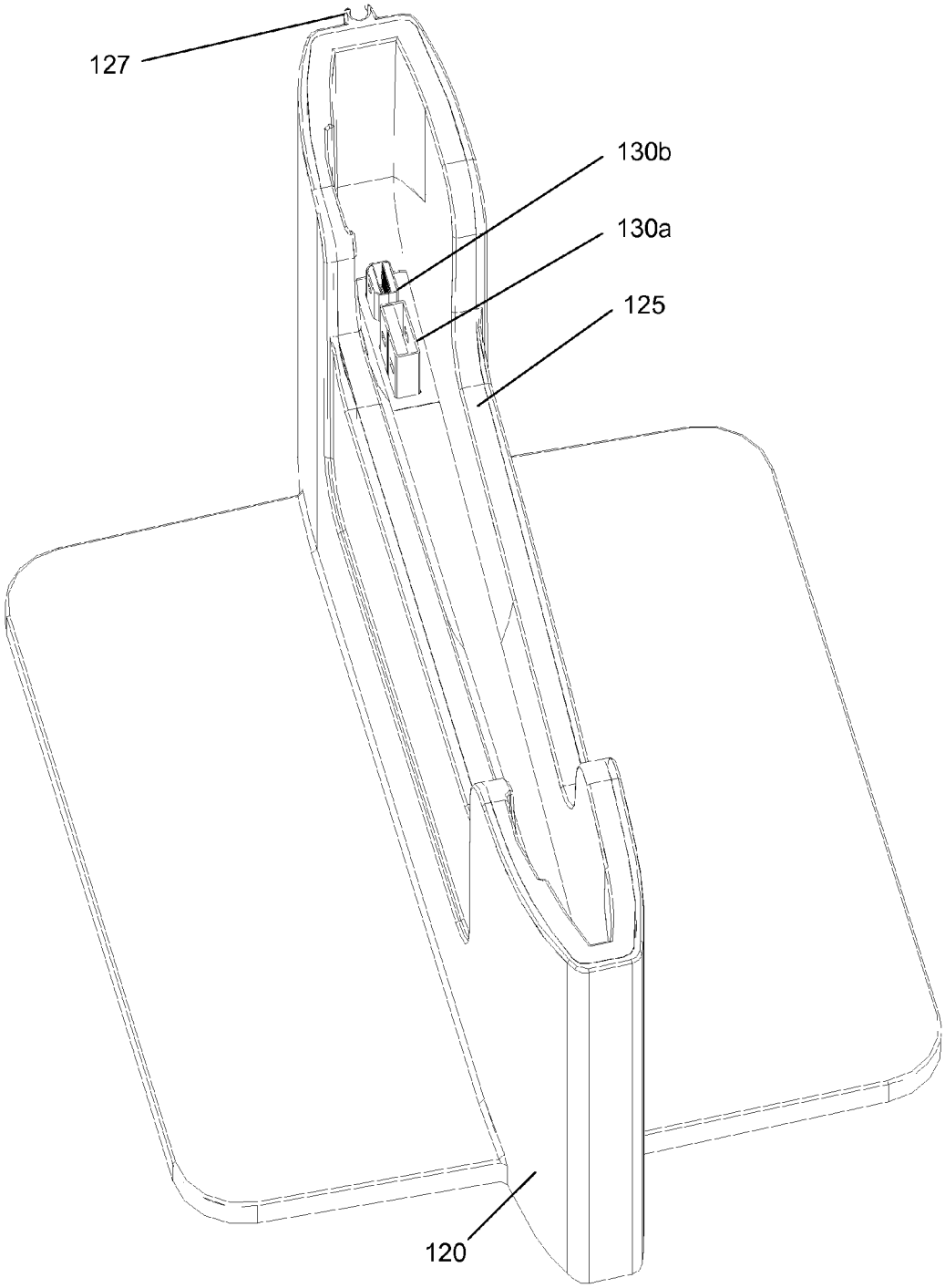
FIG. 10 is an axonometric view of a docking station according to an exemplary embodiment of the invention.

FIG. 10 is an axonometric view of a docking station according to an exemplary embodiment of the invention. As shown in FIG. 10, the docking station includes a shell 120, a liner 125, a cable retention mechanism 127, and two plugs 130*a* and 130*b*. The docking station also includes a connector module (not shown) and a base member (not shown). The liner 125 can be shaped to conform to the contours of the electronic device to be docked. The cable retention mechanism 127 can be formed as part of the shell 120. The cable retention mechanism 127 can be used to secure a loose cable (not shown) that may be connected to the opposite side of the electronic device (not shown). The cable retention mechanism 127 can be sized to match the power cable for an Apple computer such as the MacBook Air. The cable retention mechanism 127 can be a groove which is narrower at the opening than at the base. When a cable is introduced into the cable retention mechanism 127, the cable compresses slightly to pass through the narrow opening of the groove and is then retained in the between the walls of the groove.

Figure 11:
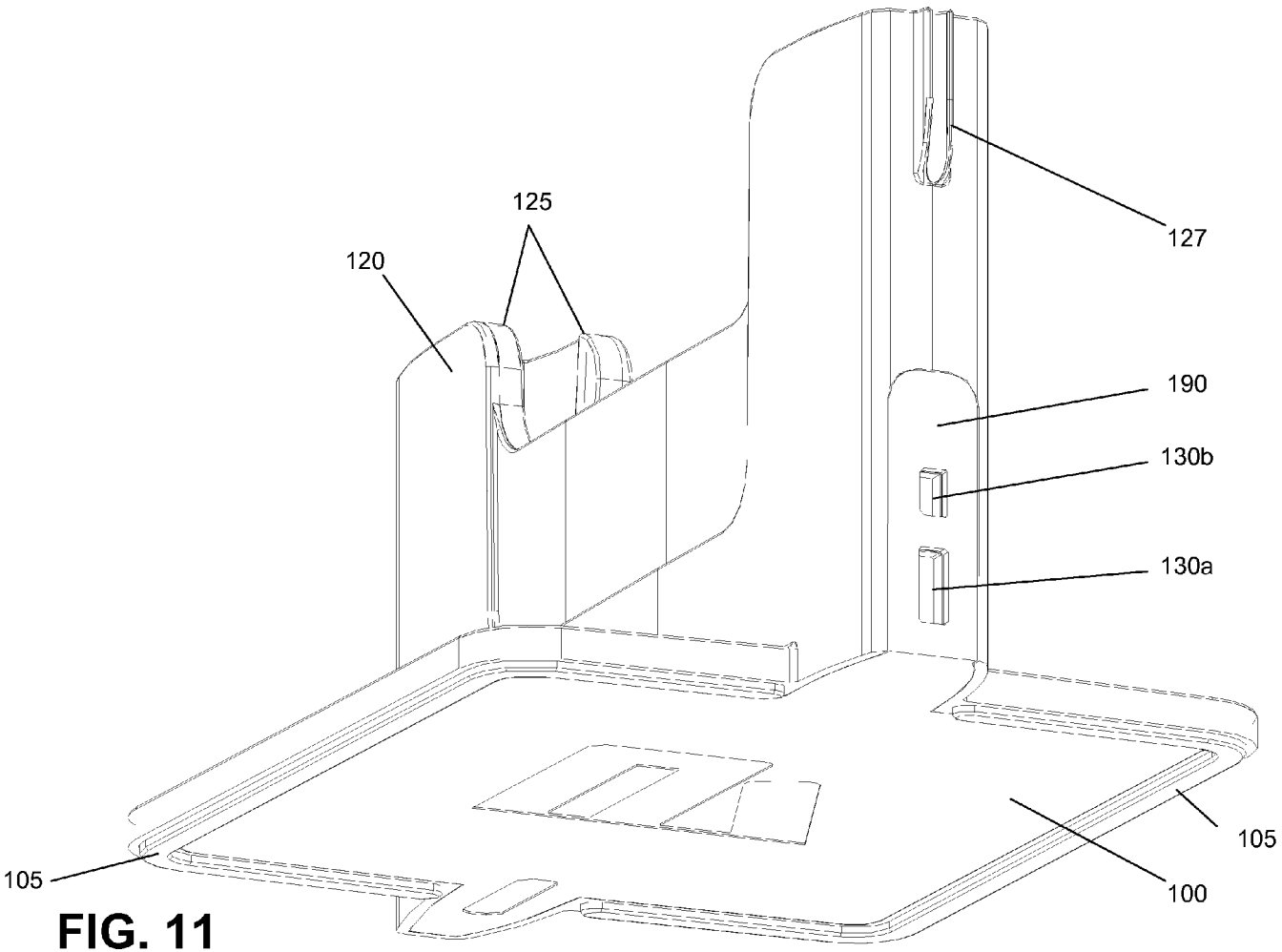
FIG. 11 is an axonometric view of a docking station according to an exemplary embodiment of the invention.

FIG. 11 is an axonometric view of a docking station according to an exemplary embodiment of the invention. As shown in FIG. 11, the docking station includes a base member 100, a shell 120, a liner 125, a perimeter foot 105, and two ports 140*a* and 140*b*. The docking station also includes a connector module (not shown). The shell 120 includes a cable retention mechanism 127. The cable retention mechanism 127 can be used to secure a loose cable (not shown) that may be connected to the opposite side of the electronic device (not shown). The cable retention mechanism 127 can be sized to match the power cable for an Apple computer such as the MacBook Air. The back wall 190 of the base member 100 can have cutouts to allow external connectors (not shown) to be inserted into the ports 140*a* and 140*b*.

The perimeter foot 105 can be formed from rubber. The perimeter foot 105 can follow the edges of the base of the docking station to prevent the docking station from sliding or moving when placed on a smooth surface. The perimeter foot 105 can be formed in multiple parts as shown in FIG. 11. The perimeter foot 105 can be attached to the base member 100 or the shell 120.

It will be apparent to those skilled in the art that various modifications and variations can be made in the docking station for an electronic device having an improved connector interface without departing from the spirit or scope of the invention. Thus, it is intended that embodiments of the invention cover the modifications and variations of this invention provided they come within the scope of the appended claims and their equivalents.

What is claimed is:

1. A connector module for attaching a plurality of external connectors to an electronic device, comprising:

a first plug insert injection molded with the connector module;

a second plug insert injection molded with the connector module;

a first port insert injection molded with the connector module;

a second port insert injection molded with the connector module;

a first electrical connection between the first plug and the first port, the first electrical connection being insert injection molded with the connector module;

a second electrical connection between the second plug and the second port, the second electrical connection being insert injection molded with the connector module;

a first positioning hole for orienting the connector module within a docking station; and a second positioning hole for orienting the connector module within the docking station.

2. The connector module of claim 1 wherein the first electrical connection and the second electrical connection are cables.

3. The connector module of claim 1 wherein the first electrical connection and the second electrical connection are electrical traces on a printed circuit board.

4. The connector module of claim 1 further comprising:

a third positioning hole for orienting the connector module within the docking station.

5. The connector module of claim 1 further comprising:

a printed circuit board insert injection molded with the connector module.

6. The connector module of claim 1 further comprising:

a third plug insert injection molded with the connector module;

a third port insert injection molded with the connector module; and a third electrical connection between the third plug and the third port, the third electrical connection being insert injection molded with the connector module.

7. A connector module for attaching a plurality of external connectors to an electronic device, comprising:

a first plug insert injection molded with the connector module;

a second plug insert injection molded with the connector module;

a first port insert injection molded with the connector module;

a second port insert injection molded with the connector module;

a first electrical connection between the first plug and the first port, the first electrical connection being insert injection molded with the connector module;

a second electrical connection between the second plug and the second port, the second electrical connection being insert injection molded with the connector module;

a first positioning hole for orienting the connector module within a docking station;

a second positioning hole for orienting the connector module within the docking station; and a third positioning hole for orienting the connector module within the docking station.

8. The connector module of claim 7 wherein the first electrical connection is a cable and the second electrical connection is a cable.

9. The connector module of claim 7 further comprising:

a printed circuit board insert injection molded with the connector module.

10. The connector module of claim 9 wherein the first electrical connection is a first trace on the printed circuit board and the second electrical connection is a second trace on the printed circuit board.

11. The connector module of claim 7 further comprising:

a third plug insert injection molded with the connector module;

a third port insert injection molded with the connector module; and a third electrical connection between the third plug and the third port, the third electrical connection being insert injection molded with the connector module.

12. A connector module for attaching a plurality of external connectors to an electronic device, comprising:

a first plug insert injection molded with the connector module;

a second plug insert injection molded with the connector module;

a third plug insert injection molded with the connector module;

a first port insert injection molded with the connector module;

a second port insert injection molded with the connector module;

a third port insert injection molded with the connector module; and a first electrical connection between the first plug and the first port, the first electrical connection being insert injection molded with the connector module;

a second electrical connection between the second plug and the second port, the second electrical connection being insert injection molded with the connector module;

a third electrical connection between the third plug and the third port, the third electrical connection being insert injection molded with the connector module; and a first positioning hole for orienting the connector module within a docking station.

* * * * *